US006074129A

United States Patent [19]

Nowak et al.

[11] Patent Number: 6,074,129

[45] Date of Patent: Jun. 13, 2000

[54] APPARATUS AND METHOD FOR SECURING A SCREED PLATE TO A FRAME MEMBER OF A SCREED ASSEMBLY

[75] Inventors: Terrence J. Nowak, Champlin; Wayne A. Anderson, Elk River, both of Minn.

[73] Assignee: Caterpillar Inc., Peoria, Ill.

[21] Appl. No.: 08/976,864

[22] Filed: Nov. 24, 1997

[51] Int. Cl.[7] ..... E01C 19/22; E04G 21/10; E04G 7/00; F16B 1/00

[52] U.S. Cl. ..... 404/96; 404/118; 403/49; 403/289

[58] Field of Search ..... 404/72, 96, 97, 404/105, 118, 119; 403/49, 289

[56] References Cited

U.S. PATENT DOCUMENTS

| | | | |
|---|---|---|---|
| 2,441,532 | 5/1948 | Millikin et al. | 404/105 |
| 3,046,856 | 7/1962 | Baxter | 404/118 |
| 3,206,174 | 9/1965 | Young | 404/105 |
| 3,362,306 | 1/1968 | Frantz | 404/118 |
| 3,412,658 | 11/1968 | Griffin | 404/119 |
| 4,316,715 | 2/1982 | Allen | 425/456 |
| 4,848,959 | 7/1989 | Morrison | 404/112 |
| 4,865,487 | 9/1989 | Lutz | 404/118 |
| 5,203,642 | 4/1993 | Heller et al. | 404/118 |
| 5,222,829 | 6/1993 | Mogler et al. | 404/118 |
| 5,301,485 | 4/1994 | Shaw et al. | 52/678 |
| 5,366,320 | 11/1994 | Hanlon et al. | 404/118 |
| 5,397,199 | 3/1995 | Frampton et al. | 404/118 |
| 5,567,075 | 10/1996 | Allen | 404/84.5 |

*Primary Examiner*—Eileen Dunn Lillis
*Assistant Examiner*—Gary S. Hartmann
*Attorney, Agent, or Firm*—Maginot, Addison & Moore; Jeff A. Greene

[57] ABSTRACT

An apparatus and method for securing a screed plate to a frame member of a screed assembly is disclosed. A leading edge portion of the screed plate is secured to the frame member by a number of fastening assemblies each of which includes an upper fastening block, a lower fastening block, and a bolt. The upper fastening block is welded to the frame member, whereas the lower fastening block is welded to the screed plate. Rotation of the bolt causes the fastening blocks, and hence the frame member and the screed plate, to be secured to one another. The bolt is disposed at an angle relative the screed plate thereby allowing access thereto from a rear portion of the screed assembly. Such a configuration allows the screed plate to be exchanged without the need to remove the screed assembly from the tractor associated with the paver. Such a configuration further allows the screed plate to be exchanged without the need to remove a number of deflector plates associated with the screed assembly.

16 Claims, 5 Drawing Sheets

APPARATUS AND METHOD FOR SECURING A SCREED PLATE TO A FRAME MEMBER OF A SCREED ASSEMBLY

TECHNICAL FIELD OF THE INVENTION

The present invention relates generally to a screed assembly, and more particularly to an apparatus and method for securing a screed plate to a frame member of a screed assembly.

BACKGROUND OF THE INVENTION

A work machine, such as an asphalt paver, is commonly utilized to apply a paving material, such as asphalt, to a graded surface at a work site. An asphalt paver typically includes a tractor having a screed assembly secured thereto. The screed assembly provides a mechanism for leveling the hot, relatively soft asphalt during application thereof. In particular, the screed assembly includes a screed plate having flat, smooth surface which contacts the asphalt after the same has been deposited on the graded surface. As the paver is advanced, the screed plate is drawn over the deposited asphalt thereby creating a relatively smooth, level surface before the hot asphalt material cools and hardens.

After a period of time, it is typically necessary to replace the screed plate. In particular, as the screed plate is drawn over the asphalt material, the screed plate is subjected to wear thereby reducing the useful life thereof. Once the screed plate wears beyond a predetermined limit, the screed plate must be removed from the screed assembly and thereafter exchanged for a replacement screed plate. Such replacement of the screed plate is often a laborious, time-consuming task. In particular, it is often necessary to first remove the screed assembly from the tractor. Once removed from the tractor, a number of deflector plates, which are provided to deflect or otherwise guide asphalt material during the deposit thereof, must then be removed in order to access the various fasteners which are utilized to secure the screed plate to the screed assembly. It should be appreciated that during the period of time required to exchange the screed plate, the paver is idle thereby disadvantageously decreasing the efficiency or productivity of the paver.

What is needed therefore is an apparatus and method for securing a screed plate to a frame member of a screed assembly which overcomes one or more of the above-mentioned drawbacks.

DISCLOSURE OF THE INVENTION

In accordance with a first embodiment of the present invention, there is provided an asphalt leveling subassembly adapted to be secured to a frame member of a work machine. The frame member has a first fastening block attached thereto. The first fastening block has an outwardly opening slot defined therein. The subassembly includes a screed plate. The subassembly also includes a second fastening block secured to the screed plate. The second fastening block has a fastening aperture defined therein. The subassembly further includes a fastening member which (i) extends through the outwardly opening slot, and (ii) extends into the fastening aperture.

In accordance with a second embodiment of the present invention, there is provided a method of securing a screed plate to a frame member, with (i) the frame member having a first fastening block secured thereto, (ii) the first fastening block having an outwardly opening slot defined therein, (iii) the screed plate having a second fastening block secured thereto, and (iv) the second fastening block having a fastening aperture defined therein. The method includes the step of positioning a fastening member in the fastening aperture of the second fastening block. The method further includes the step of locating the screed plate under the frame member such that the fastening member is positioned in the outwardly opening slot of the first fastening block. The method also includes the step of rotating the fastening member so as to move the screed plate toward the frame member.

In accordance with a third embodiment of the present invention, there is provided a screed assembly. The screed assembly includes a frame member. The screed assembly also includes a first fastening block secured to the frame member. The first fastening block has both (i) an outwardly opening slot, and (ii) an aligning notch defined therein. The screed assembly further includes a screed plate. The screed plate is positionable between a first screed plate position and a second screed plate position. The screed plate is located a first distance from the frame member when the screed plate is positioned at the first screed plate position. The screed plate is located a second distance from the frame member when the screed plate is positioned at the second screed plate position. The first distance is greater than the second distance. Moreover, the screed assembly includes a second fastening block secured to the screed plate. The second fastening block has both (i) a fastening aperture, and (ii) an aligning surface defined therein. The screed assembly yet further includes a fastening member which extends through the outwardly opening slot and the fastening aperture. Rotation of the fastening member causes (i) movement of the screed plate from the first screed plate position to the second screed plate position, and (ii) the aligning surface to be received into the aligning notch so as to align the first fastening member relative to the second fastening member.

BEST MODE FOR CARRYING OUT THE INVENTION

Figure 1:
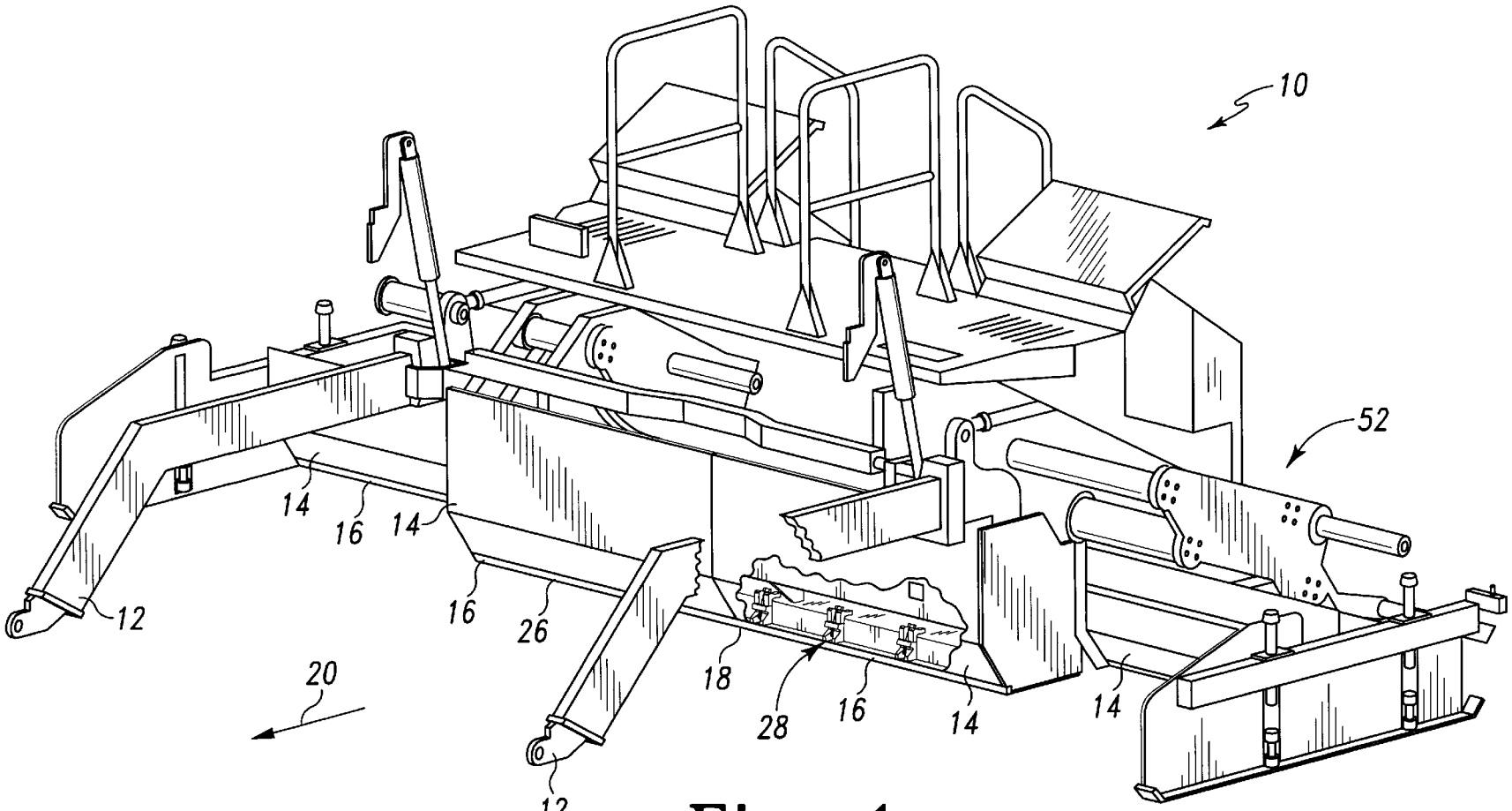
FIG. 1 is a perspective view of a screed assembly which incorporates the features of the present invention therein (note that a portion of one of the tow arms and a portion of one of the deflector plates have been cut away for clarity of description)

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
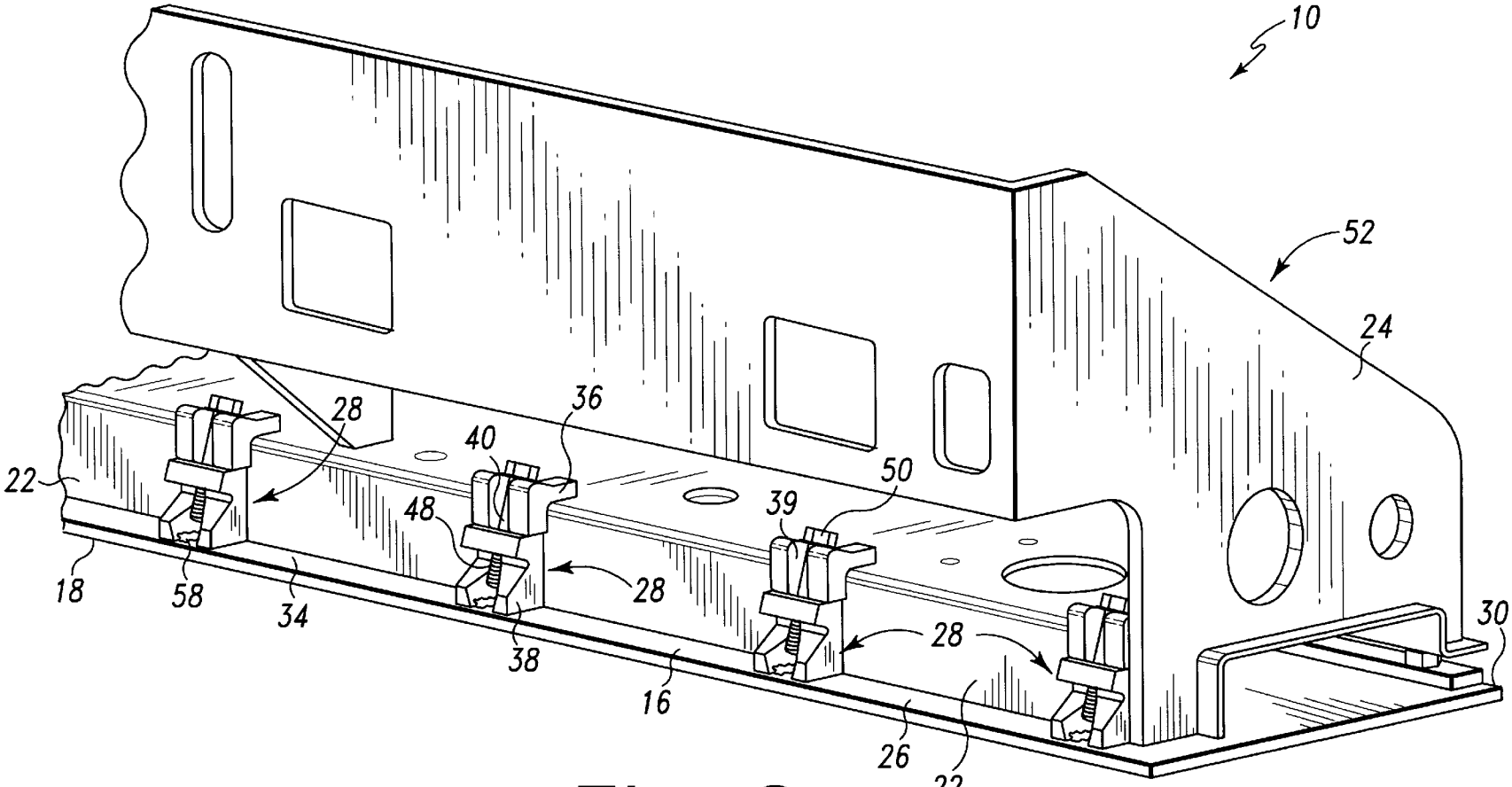
FIG. 2 is an enlarged fragmentary front perspective view of the screed assembly of FIG. 1 which shows the screed plate secured to the frame member.
Figure 3:
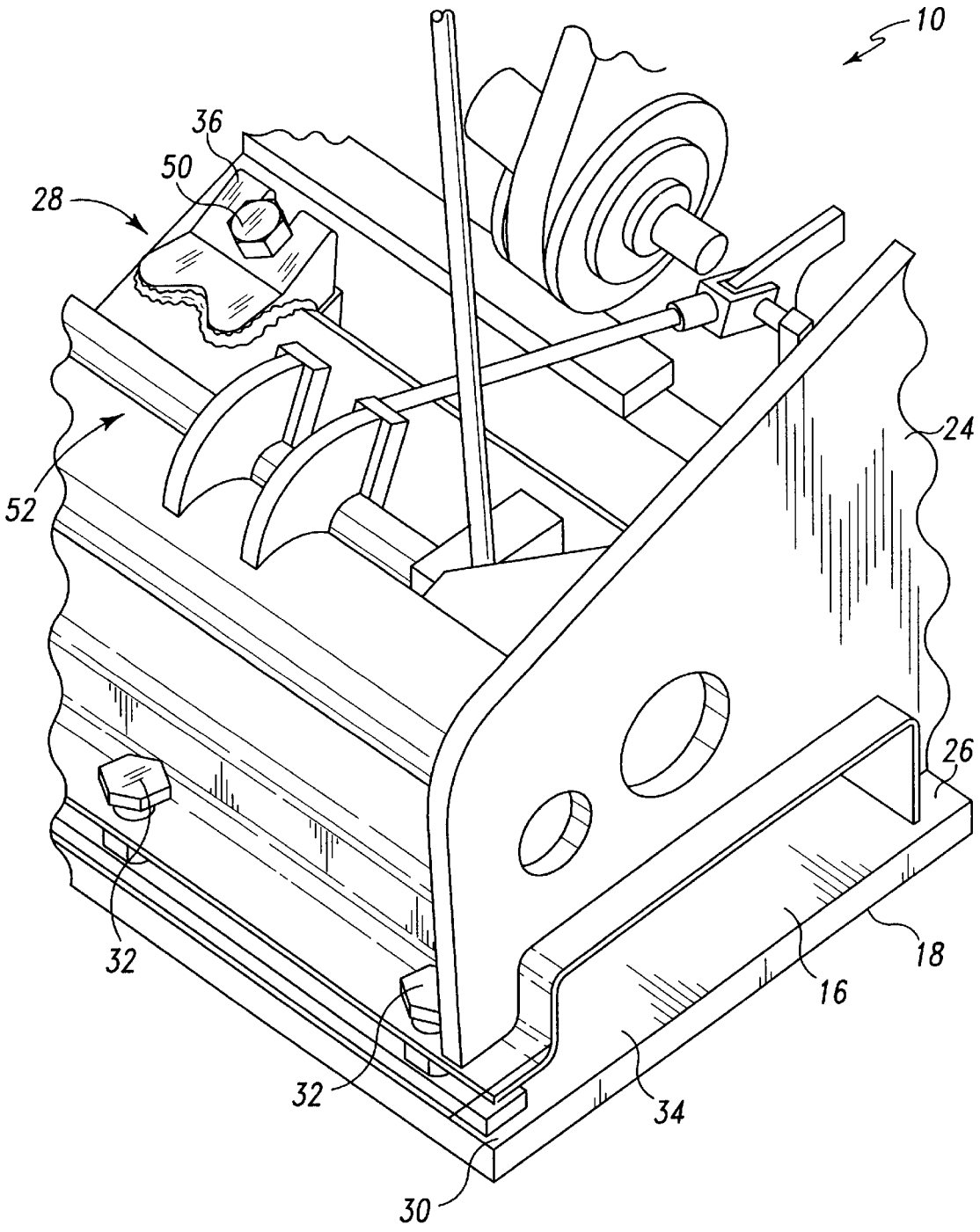
FIG. 3 is an enlarged fragmentary rear perspective view of the screed assembly of FIG. 1 which shows a rear portion thereof.

Referring now to FIGS. 1–3, there is shown a screed assembly 10. The screed assembly 10 may be secured to a tractor (not shown) of an asphalt paver by a pair of tow arms 12. During operation of the paver, a paving material, such as asphalt, is advanced out of a hopper (not shown) included in the tractor into contact with a number of deflector plates 14 thereby depositing the paving material onto a graded surface.

In order to level the hot, relatively soft asphalt during application thereof, the screed assembly 10 includes a number of screed plates 16 each of which has flat, smooth bottom surface 18 which contacts the asphalt after the same has been deposited on the graded surface. As the paver is advanced in the general direction of arrow 20 of FIG. 1, the screed plates 16 are drawn over the deposited asphalt thereby creating a relatively smooth, level surface before the hot asphalt material cools and hardens.

The screed assembly 10 further includes a number of frame members 22 which are welded or otherwise secured to a number of structural members 24. The screed plates 16 are secured to the frame members 22 thereby allowing a number of heaters, such as liquid propane burners (not shown), which are housed within the frame members 22 to heat the screed plate 16. In particular, a leading edge portion 26 of each of the screed plates 16 is secured to the frame member 22 by a number of fastening assemblies 28, whereas a trailing edge portion 30 of each of the screed plates 16 is secured to the frame member 22 by a number of bolts 32 thereby allowing heat generated by the heaters positioned within the frame members 22 to be transferred to an upper surface 34 of the screed plate 16 in order to heat the screed plate 16 during operation of the paver.

Figure 4:
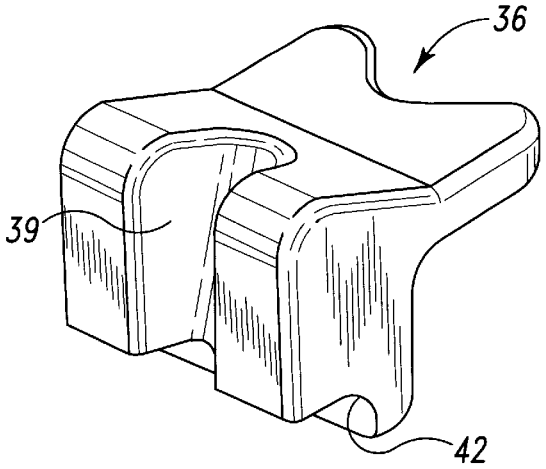
FIG. 4 is a perspective view of the upper fastening block of the screed assembly of FIG. 1.
Figure 5:
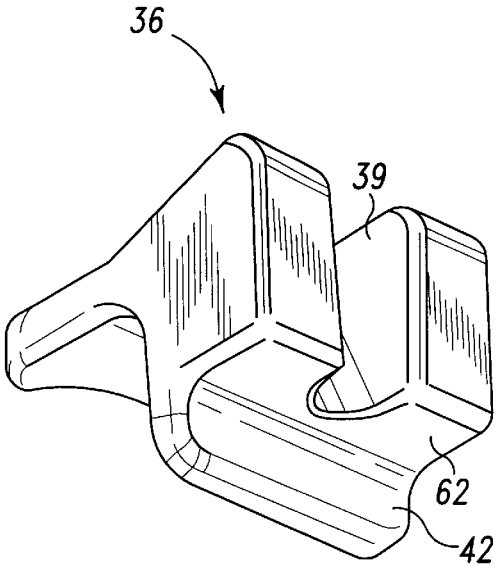
FIG. 5 is a view similar to FIG. 4 which shows the aligning notch of the upper fastening block.

Each of the fastening assemblies 28 includes a first or upper fastening block 36, a second or lower fastening block 38, and a fastening member or bolt 40. The upper fastening blocks 36 are welded or otherwise secured to the frame member 22, as shown in FIG. 2, whereas the lower fastening blocks 38 are welded or otherwise secured to the upper surface 34 of the screed plate 16. Each of the upper fastening blocks 36 has an outwardly opening slot 39 defined therein (see FIGS. 4 and 5) so as to receive the bolt 40 therein.

What is meant herein by the term "outwardly opening slot" is a channel, recess, groove, or other voided area defined in the upper fastening block 36 which allows the bolt 40 to be laterally received therein. Use of such an outwardly opening slot is advantageous in that the bolt 40 may first be pre-inserted into the lower fastening block 38, and thereafter advanced into the outwardly opening slot 39 thereby eliminating the need to first align the upper fastening block 36 with the lower fastening block 38 prior to insertion of the bolt 40. As shall be discussed below in more detail, such pre-insertion of the bolt 40 and subsequent lateral receipt of the bolt 40 in the outwardly opening slot 39 facilitates efficient removal and replacement of the screed plate 16 during a screed plate exchange procedure.

The upper fastening block 36 further has an aligning notch 42 defined therein. As shall be discussed below in more detail, the aligning notch 42 cooperates with an aligning surface 44 (see FIGS. 6 and 7) defined in each of the lower fastening blocks 38 so as to align the upper fastening blocks 36 with the lower fastening block 38 when the upper fastening block 36 is secured to the lower fastening block 38.

Figure 6:
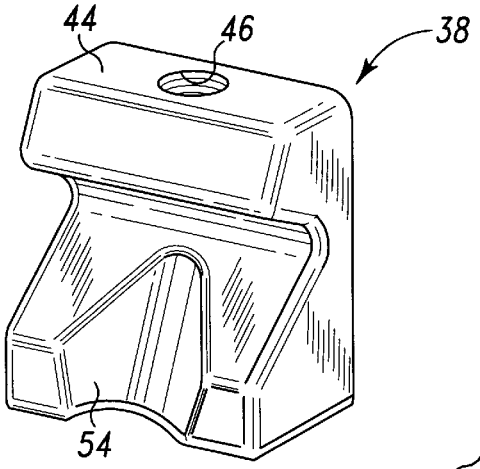
FIG. 6 is a side perspective view of the lower fastening block of the screed assembly of FIG. 1.
Figure 7:
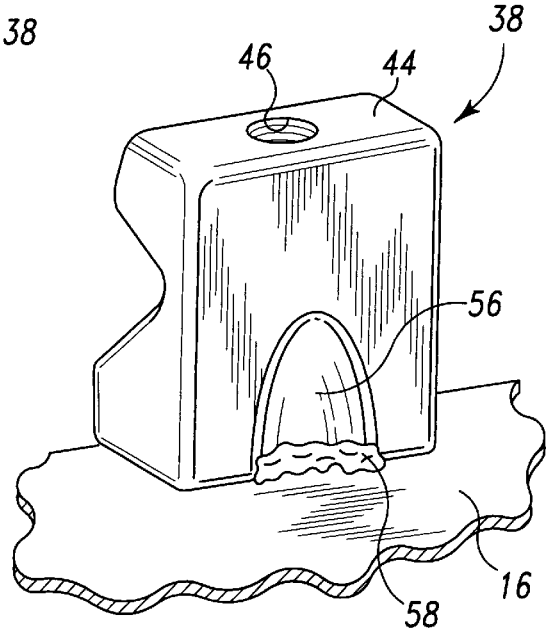
FIG. 7 is a rear perspective view of the lower fastening block of the screed assembly of FIG. 1.
Figures 8, 9, 10:
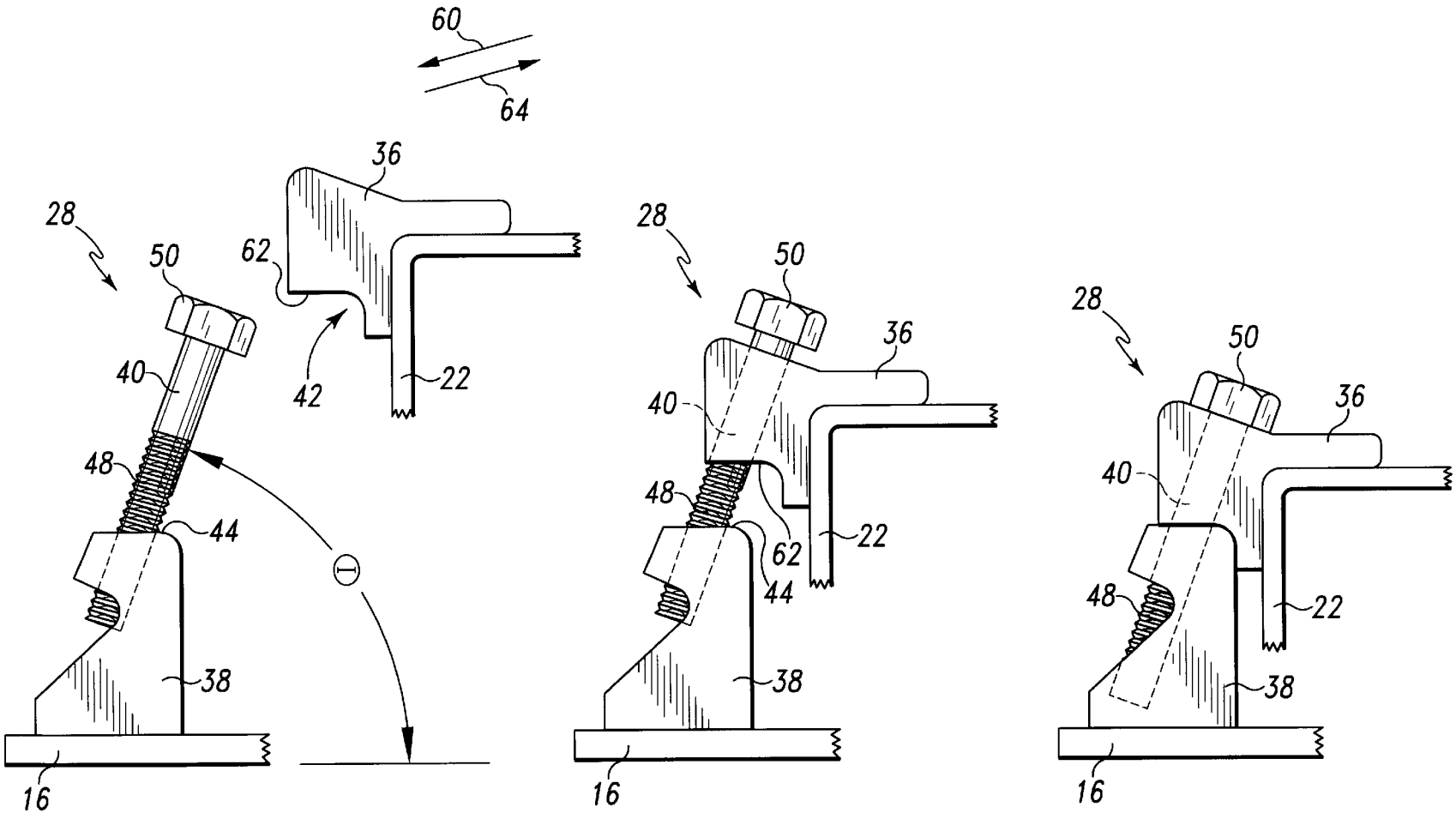
FIG. 8 is a fragmentary side view of the screed assembly of FIG. 1 which shows the upper fastening block being moved toward the lower fastening block (note that the structural members have been removed for clarity of description)
FIG. 9 is a view similar to FIG. 8, but showing the bolt being received into the outwardly opening slot of the upper fastening block.
FIG. 10 is a view similar to FIG. 8, but showing the upper fastening block secured to the lower fastening block.

Each of the lower fastening blocks 38 has an internally threaded fastening aperture 46 defined therein. As shown in FIGS. 6 and 7, one end of the fastening aperture 46 is defined in the aligning surface 44. An externally threaded end portion 48 of the bolt 40 threadingly engages the fastening aperture 46 during rotation thereof. Moreover, the fastening aperture 46 is configured such that when the end portion 48 of the bolt 40 is positioned therein, a head portion 50 of the bolt 40 may be accessible with a work tool, such as a socket, from a rear portion 52 (see FIG. 3) of the screed assembly 10. In particular, when positioned in the fastening aperture 46, the bolt 40 and the screed plate 16 define a rearwardly tilted angle $\Theta$, as shown in FIG. 8. As alluded to above, the magnitude of the angle $\Theta$ is predetermined in order to render the head portion 50 accessible with a socket or the like which is coupled to a pneumatic or manual socket driver (not shown). The magnitude of the angle $\Theta$ is $60° < \Theta < 80°$. Preferably, the magnitude of the angle $\Theta$ is 70°.

It should be appreciated that by allowing access to the head portion 50 of the bolts 40 from the rear portion 52 of the screed assembly 10, the screed plate 16 may be exchanged for a replacement screed plate more quickly and easily relative to screed assemblies which have heretofore been designed. In particular, by allowing access to the head portion 50 of each of the bolts 40, an operator or technician associated with the paver may loosen or otherwise remove each of the bolts 40 without first having to (1) remove the screed assembly 10 from the tractor (not shown) of the paver, and (2) remove one or more of the deflector plates 14. It should further be appreciated that avoidance of such disassembly of the paver reduces the amount of time in which the paver must be inoperable during exchange of the screed plate 16 thereby increasing the efficiency or productivity associated with the paver.

Each of the lower fastening blocks 38 further has a pair of welding notches 54, 56 (see FIGS. 6 and 7) defined therein. A welding material 58 (see FIG. 2) may be disposed in each of the welding notches 54, 56 thereby securing the lower fastening block 38 to the upper surface 34 of the screed plate 16. It should be appreciated that by welding the lower fastening blocks 38 to the screed plate 16 in such a manner, it is not necessary to create a weld around the entire periphery of the lower fastening block 38 thereby reducing the number of occasions in which the screed plate 16 is warped or otherwise deformed during attachment of the lower fastening blocks 38 thereto. It should also be appreciated that the welding notch 54 provides clearance for the threaded end portion 48 of the bolt 40 as the bolt 40 is tightened or otherwise advanced through the fastening aperture 46.

INDUSTRIAL APPLICABILITY

In operation, it may become desirable to secure to secure a replacement screed plate 16 to the frame member 22. In order to do so, the screed assembly 10 (without the prior screed plate 16 being attached thereto) is first urged by a number of actuators (not shown), such as hydraulic cylinders, associated therewith such that the frame member 22 and hence the upper fastening block 36 is advanced in the general direction of arrow 60 of FIG. 8 toward the replacement screed plate 16 and hence the lower fastening block 38. It should be appreciated that the replacement screed plate 16 may be positioned at rest on a flat surface prior to advancement of the frame member 22. Moreover, as shown in FIG. 8, the bolt 40 is positioned in the fastening aperture 46 of the lower fastening block 38 prior to advancement of the frame member 22.

As the frame member 22 continues to be advanced toward the replacement screed plate 16, the bolt 40 is received into the outwardly opening slot 39 of the upper fastening block 36, as shown in FIG. 9. Once the bolt 40 is positioned in the slot 39, an operator or technician associated with the paver may then reach through the rear portion 52 (see FIG. 3) of the screed assembly 10 with a socket (not shown) in order to place the socket on the head portion 50 of the bolt 40. Rotation of the bolt 40 in a first direction causes the threaded end portion 48 of the bolt 40 to threadingly engage the fastening aperture 46 thereby causing the frame member 22 and the screed plate 16 to be urged toward one another. The frame member 22 and the replacement screed plate 16 continue to be urged toward one another until the aligning surface 44 of the lower fastening block 38 contacts an aligning surface 62 (see FIG. 5) within the aligning notch 42 of the upper fastening block 36. Once the aligning surface 44 of the lower fastening block 38 is in contact with the aligning surface 62 of the upper fastening block 36, upper fastening block 36 and hence the replacement screed plate 16 is aligned with the lower fastening block 38 and hence the frame member 22.

It should be appreciated that either prior to or subsequent to securing the fastening blocks 36, 38 to one another, the operator or technician may also insert and thereafter tighten the bolts 32 (see FIG. 3) thereby securing the trailing edge portion 30 of the screed plate 16 to the frame member 22.

After a period of use sufficient to cause the screed plate to become worn, it may be desirable to detach the screed plate 16 from the frame member 22. In order to achieve the above, the operator or technician associated with the paver may first reach through the rear portion 52 (see FIG. 3) of the screed assembly 10 with a socket (not shown) in order to place the socket on the head portion 50 of the bolt 40. Rotation of the bolt 40 in a second direction causes the threaded end portion 48 of the bolt 40 to threadingly disengage the fastening aperture 46 thereby causing the frame member 22 and the worn screed plate 16 to be urged away from one another. As the frame member 22 and the worn screed plate 16 continue to be urged away one another, the aligning surface 44 of the lower fastening block 38 become spaced apart from the aligning surface 62 (see FIG. 5) of the upper fastening block 36.

The screed assembly 10 (without the worn screed plate 16) may then be advanced by the actuators (not shown) associated with the screed assembly 10 such that the frame member 22 and hence the upper fastening block 36 is advanced in the general direction of arrow 64 of FIG. 8 away from the worn screed plate 16 and hence the lower fastening block 38. Once spaced apart from the frame member 22, the worn screed plate 16 may then be manually removed from under the frame member 22. A replacement screed plate 16 may then be mounted to the frame member 22 in the manner previously described.

It should be appreciated that either prior to or subsequent to detaching the fastening blocks 36, 38 from one another, the operator or technician may also loosen and thereafter remove the bolts 32 (see FIG. 3) thereby detaching the trailing edge portion 30 of the screed plate 16 from the frame member 22.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

In particular, it should be appreciated that a number of the components associated with the screed assembly 10 may be modified to facilitate a particular design thereof. For example, the frame member 22 may be configured to include a number of slots or notches (not shown) defined therein. The upper fastening blocks 36 may be positioned in such slots or notches in order to position the upper fastening blocks 36 in a relatively flush mount relation the frame member 22.

Moreover, the screed assembly 10 may be configured to include a tamping mechanism which tamps or otherwise compacts the asphalt as the same is deposited on the graded surface. If configured in such a manner, the lower fastening blocks 38 may function as a stop mechanism which prevents the tamping mechanism from contacting the screed plate 16 during operation thereof.

What is claimed is:

1. An asphalt leveling subassembly adapted to be secured to a frame member of a work machine, comprising:

a first fastening block having an outwardly opening slot disposed therein and being attached to the frame member of said work machine;

a screed plate;

a second fastening block secured to said screed plate, said second fastening block having a fastening aperture defined therein; and a fastening member being laterally received by and extending through said outwardly opening slot, said fastening member extending into said fastening aperture and rotation of said fastening member moves said second fastening block into contact with said first fastening block.

2. The subassembly of claim 1, wherein:

said screed plate is positionable between a first screed plate position and a second screed plate position, said screed plate being located a first distance from said frame member when said screed plate is positioned at said first screed plate position, said screed plate being located a second distance from said frame member when said screed plate is positioned at said second screed plate position, said first distance is greater than said second distance, and rotation of said fastening member causes movement of said screed plate from said first screed plate position to said second screed plate position.

3. The subassembly of claim 1, wherein:

an angle $\Theta$ is defined by said fastening member and said screed plate when said fastening member is positioned in said fastening aperture of said second fastening block, and said angle $\Theta$ is $0° < \Theta < 90°$.

4. The subassembly of claim 3, wherein said angle $\Theta$ is $60° < \Theta < 80°$.

5. The subassembly of claim 1, wherein:

said first fastening block has an aligning notch defined therein, said second fastening block has an aligning surface defined therein, and rotation of said fastening member causes said aligning surface to be received into said aligning notch so as to align said first fastening member relative to said second fastening member.

6. The subassembly of claim 5, wherein:

a first end of said fastening aperture of said second fastening block is defined in said aligning surface.

7. The subassembly of claim 1, wherein:

said fastening aperture of said second fastening block is internally threaded, said fastening member has an end portion which is externally threaded, and said fastening member threadingly engages said fastening aperture when said fastening member is rotated.

8. The subassembly of claim 1, wherein:

said second fastening block has a first welding notch and a second welding notch defined therein, and a welding material is disposed in each of said first welding notch and said second welding notch so as to secure said second fastening block to said screed plate.

9. A method of securing a screed plate to a frame member, with (i) the frame member having a first fastening block secured thereto, (ii) the first fastening block having an outwardly opening slot defined therein, (iii) the screed plate having a second fastening block secured thereto, and (iv) the second fastening block having a fastening aperture defined therein, comprising the steps of:

positioning a fastening member in the fastening aperture of the second fastening block;

locating the screed plate under the frame member such that the fastening member is laterally received by and positioned in the outwardly opening slot of the first fastening block; and rotating the fastening member so as to move the second fastening block attached to the screed plate into contact with the first fastening block that is attached to the frame member.

10. The method of claim 9, wherein:

the first fastening block has an aligning notch defined therein, the second fastening block has an aligning surface defined therein, and the rotating step includes the step of advancing the aligning surface into the aligning notch.

11. A screed assembly, comprising:

a frame member;

a first fastening block secured to said frame member, said first fastening block having both (i) an outwardly opening slot, and (ii) an aligning notch defined therein;

a screed plate, wherein (i) said screed plate is positionable between a first screed plate position and a second screed plate position, (ii) said screed plate is located a first distance from said frame member when said screed plate is positioned at said first screed plate position, (iii) said screed plate is located a second distance from said frame member when said screed plate is positioned at said second screed plate position, and (iv) said first distance is greater than said second distance, a second fastening block secured to said screed plate, said second fastening block having both (i) a fastening aperture, and (ii) an aligning surface defined therein, said aligning surface defining a first end of said fastening aperture of said second fastening block; and a fastening member extends through said outwardly opening slot and into said fastening aperture, wherein rotation of said fastening member causes (i) movement of said screed plate from said first screed plate position to said second screed plate position, and (ii) said aligning surface to be received into said aligning notch so as to align said first fastening member relative to said second fastening member.

12. The subassembly of claim 11, wherein:

an angle $\Theta$ is defined by said fastening member and said screed plate when said fastening member is positioned in said fastening aperture of said second fastening block, and said angle $\Theta$ is $0° < \Theta < 90°$.

13. The screed assembly of claim 12, wherein said angle $\Theta$ is $60° < \Theta < 80°$.

14. The screed assembly of claim 11, wherein:

said fastening aperture of said second fastening block is internally threaded, said fastening member has an end portion which is externally threaded, and said fastening member threadingly engages said fastening aperture when said fastening member is rotated.

15. The screed assembly of claim 11, wherein:

said second fastening block has a first welding notch and a second welding notch defined therein, and a welding material is disposed in each of said first welding notch and said second welding notch so as to secure said second fastening block to said screed plate.

16. The subassembly of claim 11, wherein:

said first fastening block has an aligning notch defined therein, said second fastening block has an aligning surface defined therein, and rotation of said fastening member causes said aligning surface to be received into said aligning notch so as to align said first fastening member relative to said second fastening member.

* * * * *